United States Patent [19]

Holland

[11] 4,002,211

[45] Jan. 11, 1977

[54] CABLE OPERATED APPARATUS FOR FORMING PILES

[75] Inventor: Henry A. Nelson Holland, Houston, Tex.

[73] Assignee: Raymond International Inc., Houston, Tex.

[22] Filed: Sept. 19, 1974

[21] Appl. No.: 507,613

[52] U.S. Cl. ..... 173/87; 173/139

[51] Int. Cl. ..... E02D 7/08

[58] Field of Search ..... 173/87, 139; 299/37; 254/139.1, 139, 172, 173 R; 192/17 R, 17 A; 175/189; 267/125, 137, 170, 171

[56] References Cited

UNITED STATES PATENTS

| | | | |
|---|---|---|---|
| 559,812 | 5/1896 | Ross | 299/37 X |
| 2,193,293 | 3/1940 | Nichols | 173/87 X |
| 2,425,018 | 8/1947 | Williams | 173/139 X |
| 2,712,932 | 7/1955 | Gould | 267/125 X |
| 3,749,446 | 7/1973 | Doty | 173/87 X |

*Primary Examiner*—Ernest R. Purser
*Attorney, Agent, or Firm*—Fitzpatrick, Cella, Harper & Scinto

[57] ABSTRACT

Method and apparatus for forming piles in the earth with a pile hammer rig having a hoisting drum carried by a crane, driving and braking apparatus for the drum, a drop-weight, a hoisting rope leading from the drum for lifting the drop-weight, apparatus for selectively absorbing kinetic energy of the drum and rope disposed adjacent the drop-weight; apparatus for applying the drum brake prior to impact of the drop-weight; and a fluid swivel system for connecting the drop-weight to the hoisting rope.

15 Claims, 28 Drawing Figures

16
35
34

32
14
30
26
18
12
16

28
40
14
24
10
19
20
22

DROP
DRUM FRICTION & ACCELERATION

RIG WITHOUT SLACK SPRING

LIFT
7000 LBS.
10
12
14
16
18
19
20
24
26
36
38

OVERSHOOT

IMPACT

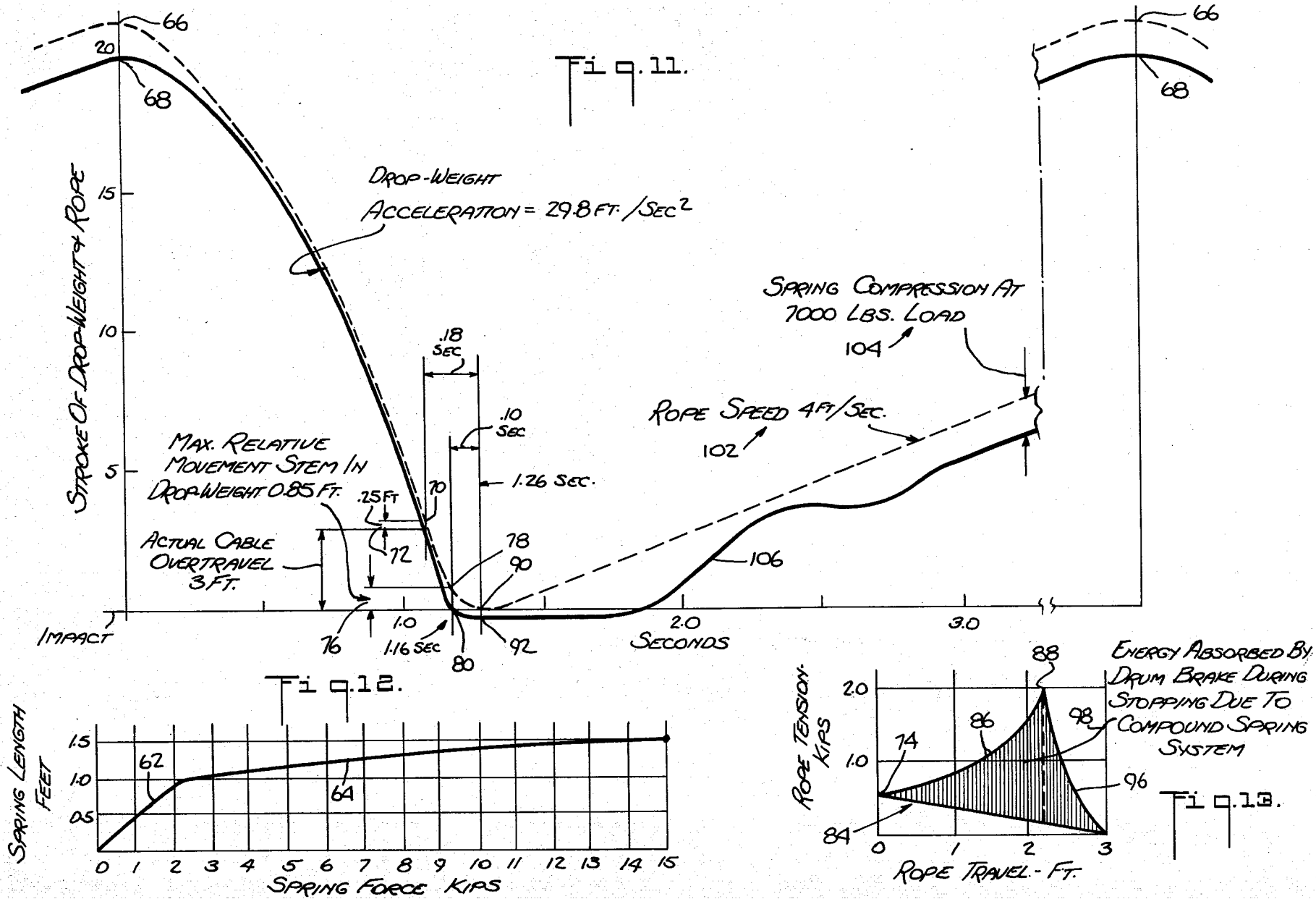
Fig. 11.
Stroke Of Drop-Weight & Rope
Drop-Weight Acceleration = 29.8 Ft./Sec²
Spring Compression At 7000 Lbs. Load
Rope Speed 4 Ft./Sec.
Max. Relative Movement Stem In Drop-Weight 0.85 Ft.
Actual Cable Overtravel 3 Ft.
.18 Sec
.10 Sec
1.26 Sec.
1.16 Sec
Impact
2.0 Seconds
Fig. 12.
Spring Force Kips
Spring Length Feet
Fig. 13.
Energy Absorbed By Drum Brake During Stopping Due To Compound Spring System
Rope Tension Kips
Rope Travel - Ft.

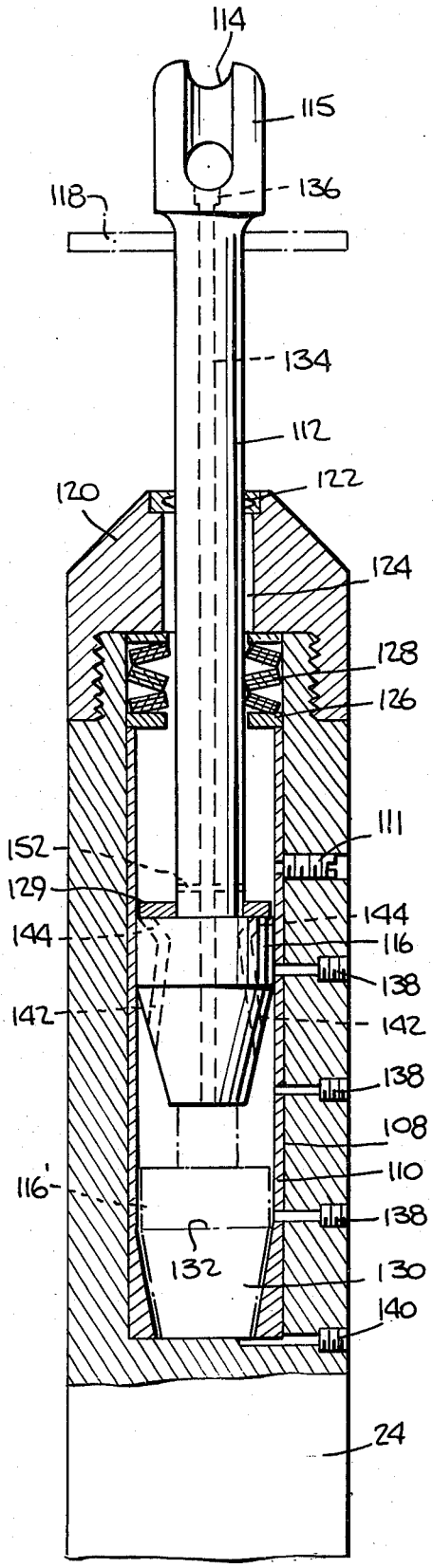
Fig. 14.
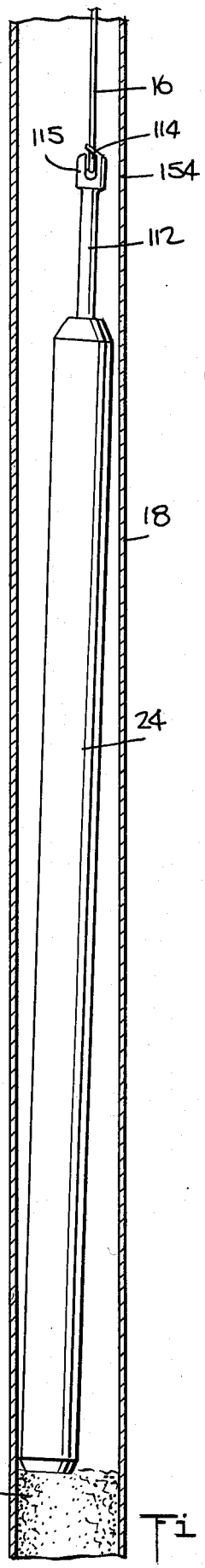
Fig. 18.
Fig. 26.
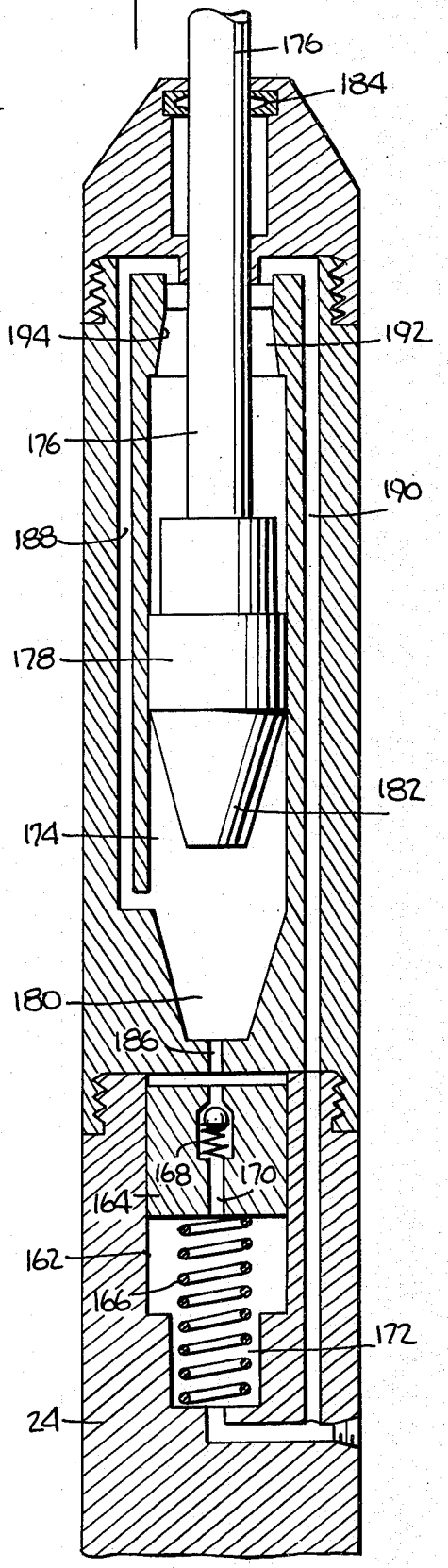

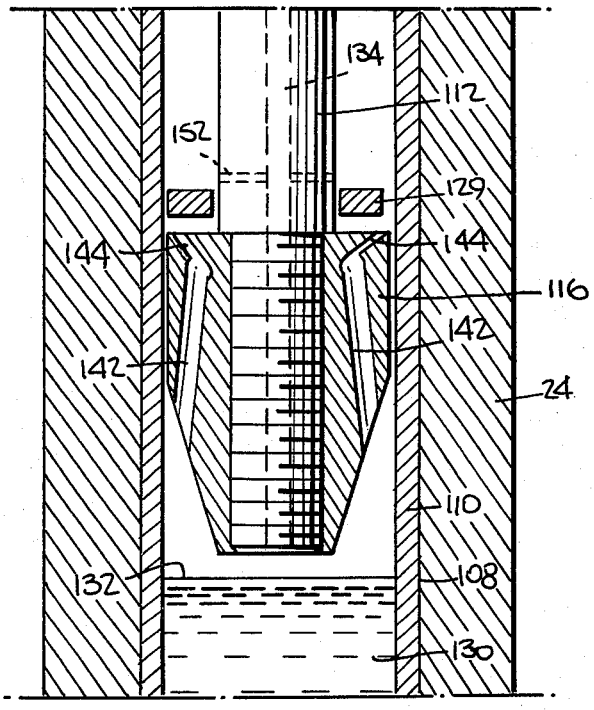
Fig. 15.
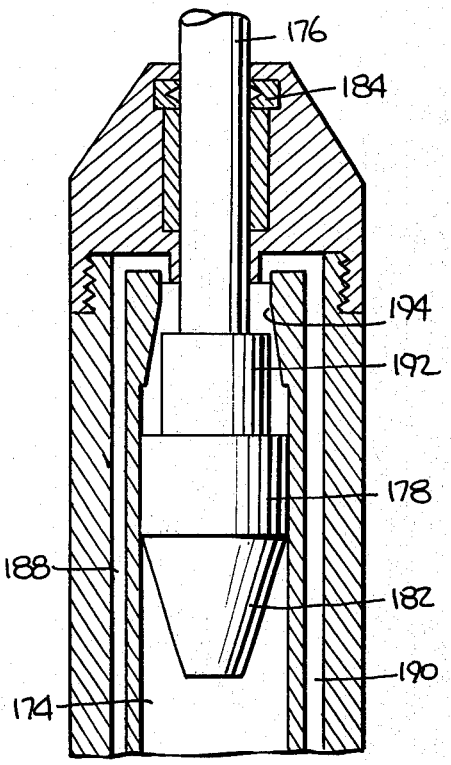
Fig. 21.
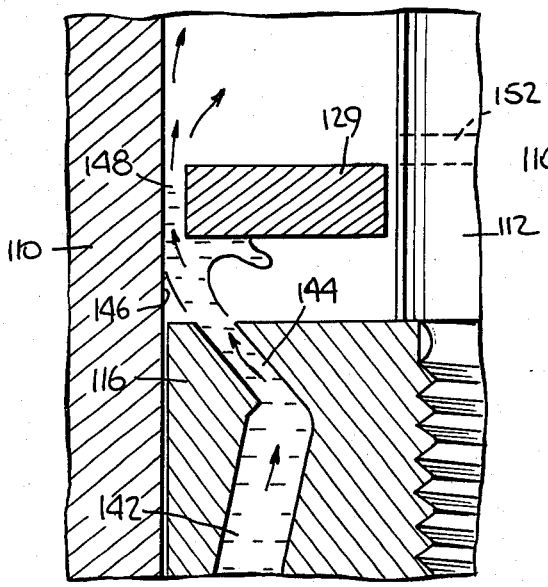
Fig. 16.
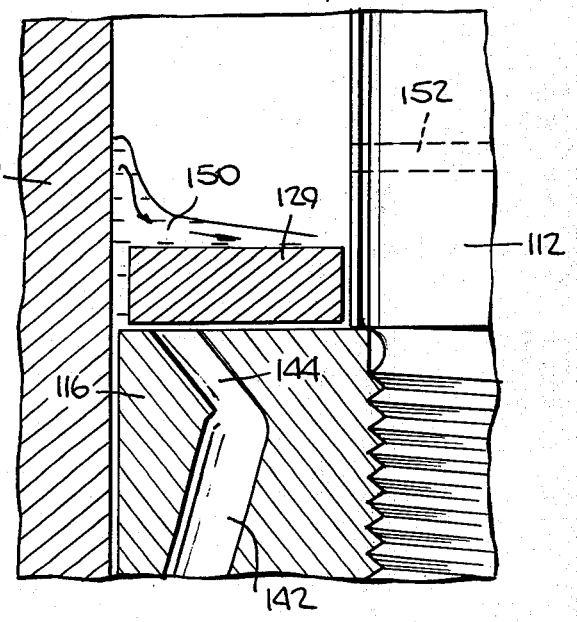
Fig. 17.
Fig. 18.
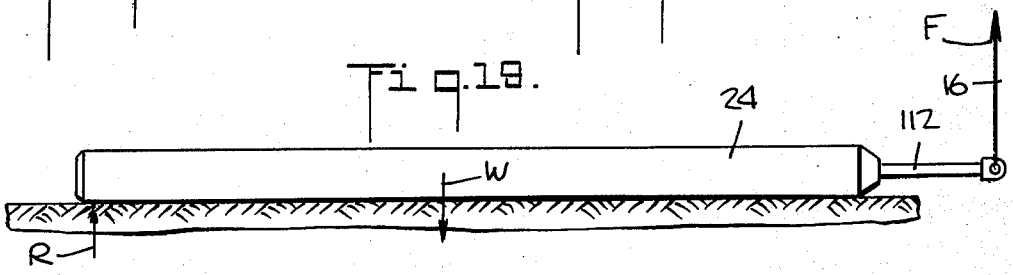

216
226
228
214
212
210
224
218
220
246
248
208
206
200
244
242
254
204
236
202
250
222
234
252
196
230
198
232
240
238
24

CABLE OPERATED APPARATUS FOR FORMING PILES

This invention relates to method and apparatus for forming piles and is particularly adapted for use in connection with the formation of piles having expanded bases, bulb piles or piles with pressure injected footings.

In the production of the type of piles variously referred to as "bulb piles", "expanded base piles" or "pressure injected footings", a drop-weight is used to compact concrete in the bottom of an open-ended tube, thereby forming a plug which is utilized to drive the tube into the ground. When a desired depth of penetration is reached the tube is restrained from further movement and additional blows of the drop-weight are used to compact and extrude additional concrete below the end of the tube, thereby compacting the surrounding soil and forming an expanded base. Thereafter, various means are used to provide a shaft to transmit future loads to the base. During the formation of the plug and the base, concrete is fed into the upper end of the tube as required and falls through the annular space between the drop-weight and the tube. The drop-weight typically weighs about 7,000 pounds and is normally about 12 inches in diameter and about 19 feet long, for example.

Various lengths of drop of the drop-weight are used with the maximum normally being about 20 feet. The drop-weight is lifted on a wire hoisting rope connected to the drum of a hoist and is allowed to fall freely by releasing the clutch mechanism of the hoist. During the drop, the durm accelerates to a rotational speed dictated by the terminal velocity of the drop-weight. At the moment of impact the operator re-engages the clutch and applies the brake to bring the drum to rest. The amount of rotation of the drum after impact results in an accumulation of slack in the rope, which has damaging effects on the rope for several reasons. At the point of attachment of the cable to the drop-weight, the sudden stopping of the weight combined with the continued downward movement of the rope produces a sudden change from a tension to a compression condition. This results in a rapid and sharp flexing of the rope just above the drop-weight, which overstresses and fatigues the individual wires thereby resulting in rapid failure. Also, as the operator proceeds to raise the drop-weight for the next blow, the accumulated slack allows the drum to accelerate to a considerable speed in the hoisting direction before the rope becomes taut. At this moment the drop-weight is suddenly picked-up, thereby causing a shock load in the rope. In addition, as the slack forms in the rope after impact, the rope deflects from its normal "taut line" condition due to gravity and other causes. When the rope is suddenly retensioned, it is forced back into its taut condition with high lateral accelerations, resulting in a whipping action which produces high lateral loads on the various sheaves used to guide the rope and causes impact loads against various parts of the equipment which the rope strikes. This is damaging to both the rope, the sheaves and such other parts.

An object of the present invention is to provide a means of attaching the rope to the weight so that, following impact, the rope at the point of attachment will continue to be pulled downwardly by an over-travel member in or adjacent the drop-weight. Thus, this invention provides means and apparatus for keeping the rope under partial tension until it is brought to rest by the braking of the hoist drum, thereby eliminating the formation of slack and the damaging consequences described above.

In attaching the rope to the drop-weight, it has been customary to use some form of swivel connection to allow the drop-weight to rotate independently of the end of the rope. The reason for this is that it is inherent in the construction of the rope used that it tends to unwind as the load is increased and to rewind as the load is released. It has been found by experience that when a means of attachment is used which does not permit swivelling, or when the frictional resistance to swivelling is too great, the life of the rope is reduced. In most forms of swivels heretofore, it was difficult to maintain a low friction due to the entrance of abrasive dust and grit between the working surfaces and frequent manual lubrication was required between the working parts. Furthermore, the high shock loading to which the swivel was subjected at impact produced a metal surface to metal surface hammering action which tended to distort the swivel parts and generally reduce its useful life. An object of the present invention is to overcome the foregoing deficiencies.

The present invention is directed to certain aspects of these problems and, in addition, an application filed on even date herewith, of which I am a coinventor, is also directed to the solution of these problems.

The present invention involves a novel combination of features combined in such a way as to afford a very effective and practical solution of the difficulties in the problems above discussed.

These and other advantages of the method and apparatus of my invention as compared to prior art such systems and techniques heretofore utilized for the above-stated purposes, will be apparent as the description proceeds.

In essence, the invention contemplates the provision of a pile hammer rig comprising a crane, a hoisting drum carried by the crane, and driving means for the drum through a clutch mechanism. In addition, there is provided brake means for the drum, a drop-weight which may be lifted by a hoisting rope leading from the drum, and including means for selectively absorbing kinetic energy of the drum and rope disposed adjacent the drop-weight. An important aspect of my invention is the provision of means for applying the drum brake means prior to impact of the drop-weight, thereby minimizing the over-travel of the drop-weight.

In one form, the invention provides a new and improved pile hammer rig including a drop-weight and a hoisting rope for the drop-weight which is characterized by means for absorbing the over-travel of the rope with respect to the drop-weight upon impact of said drop-weight. In addition, in one form of the invention, there is provided means for absorbing shock in the rope when initiating the up-stroke of the drop-weight.

According to one aspect of the invention the absorption of the over-travel of the rope upon impact of the drop-weight and the absorption of shock in the rope when initating the drop-weight up-stroke is effected by the provision of selected spring means for the mounting of the drop-weight.

According to another aspect of the invention there is provided a new and improved device for connecting the hoisting rope to the drop-weight which is characterized by a first element connected to the rope, and means for connecting the first element to the drop-weight for movement between an upper position and a lower position with respect to the drop-weight. In one form of the invention, this first element is in the form of a rod and piston assembly mounted in a piston cylinder. Means are provided for absorbing the shock of this first element when it approaches its upper position which may include spring means and/or hydraulic means, and means are provided for absorbing shock of the first element when it approaches its lower position which also may include spring means and/or hydraulic means.

According to still another aspect of the invention there is provided a new and improved method of forming a pile with a pile hammer rig including a crane having a hoisting drum, driving means for said drum through a clutch, brake means for the drum, and a drop-weight which may be lifted by a hoisting rope leading from the drum, and including means for selectively absorbing kinetic energy of the drum and rope disposed adjacent the drop-weight, said method comprising the steps of lifting said drop-weight to a preselected height by winding the rope on the drum and thence releasing the clutch to let said drop-weight fall freely, thence braking said drum at a preselected time interval prior to impact of the drop-weight to actuate said means for absorbing kinetic energy, and subsequent to impact of said drop-weight again lifting said drop-weight.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other structures and methods for carrying out the several purposes of the invention. It is important, therefore, that this disclosure be regarded as including such equivalent constructions and methods as do not depart from the spirit and scope of the invention.

Several embodiments of the invention have been chosen for the purposes of illustration and description, and are shown in the accompanying drawings, forming a part of the specification, wherein:

FIG. 11 is a graphical representation showing time displacement curves of the drop-weight and wire rope;

FIG. 12 is a graphical representation showing the characteristics of the compound spring arrangement shown in FIGS. 8 to 10;

FIG. 13 is a graphical representation showing the energy absorbed by the drum brake during acceleration due to the compound spring system;

FIG. 14 is an enlarged, medial, vertical sectional view of an over-travel swivel assembly constructed in accordance with one aspect of my invention;

FIG. 15 is an enlarged, medial, longitudinal, sectional view of a portion of an over-travel swivel assembly according to another form of the invention;

FIG. 16 is an enlarged, sectional view of a portion of the swivel assembly of FIG. 15, showing one phase of the operation of the swivel assembly;

FIG. 17 is a sectional view similar to FIG. 16, but showing another phase of the operation of the swivel assembly;

FIG. 18 is a longitudinal view, partially in section, showing the extreme axial deflection of a drop weight in a drive tube;

FIG. 19 is a side elevation of a drop-weight schematically showing the operational forces acting thereon;

FIG. 26 is a medial, vertical, sectional view of an over-travel swivel assembly for a bulb pile hammer according to another form of my invention;

FIG. 27 is a sectional view showing a portion of the swivel assembly of FIG. 26 wherein the plunger piston is in its upper position; and FIG. 28 is a medial, vertical, sectional view of an over-travel swivel assembly for a bulb pile hammer rig according to still another form of my invention.

Figures 1, 2:
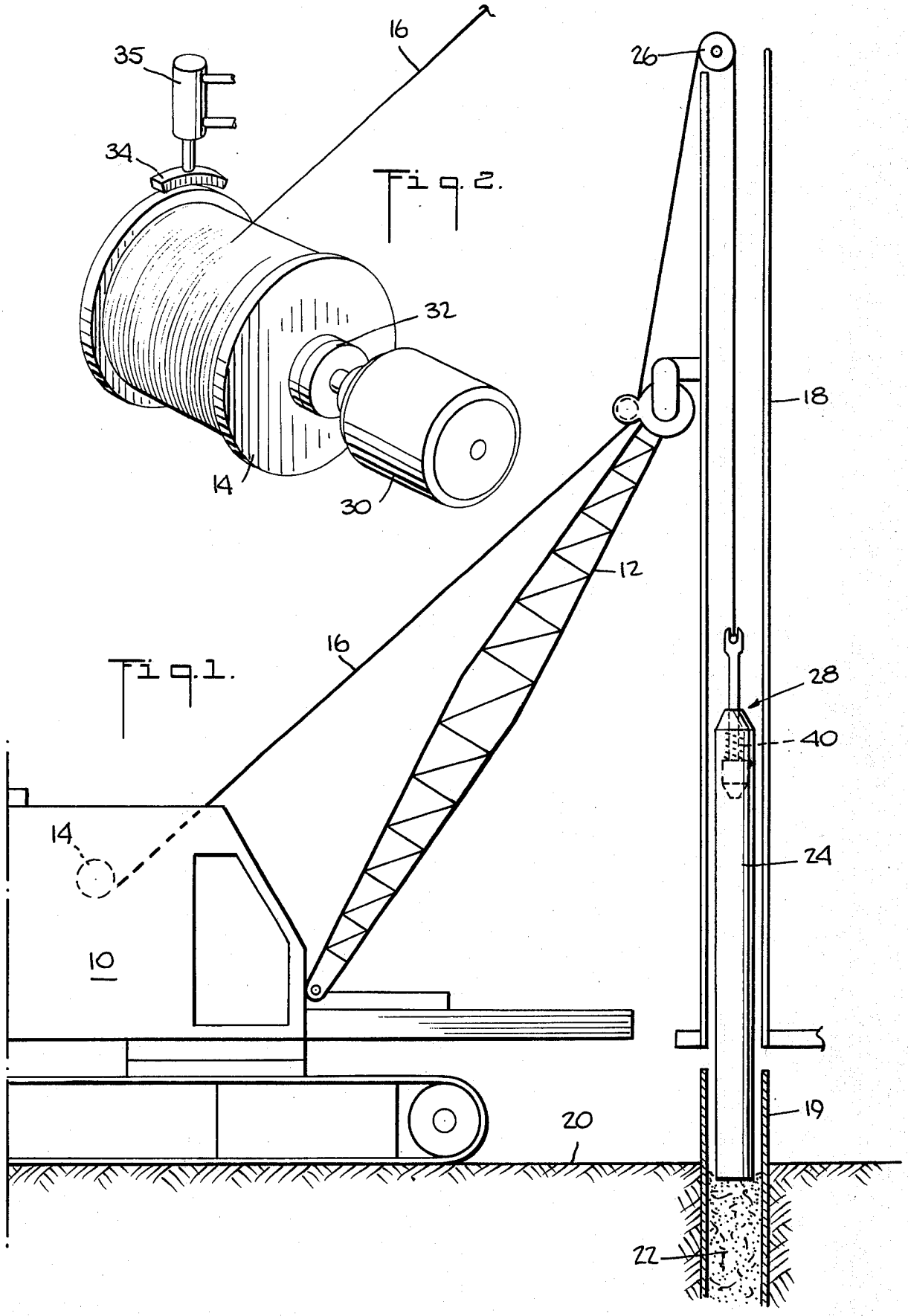
FIG. 1 is a side elevation, partially in section, of a bulb pile hammer rig constructed in accordance with the concepts of my invention.
FIG. 2 is an enlarged perspective view of a hoist drum, braking means, a clutch and driving means for use with the bulb pile hammer rig of FIG. 1.

Referring to the drawings in detail, and initially to FIG. 1, there is shown a bulb pile hammer rig which includes a crane 10 and a boom 12 having leaders 18.

The crane carries hoisting means which includes a drum 14 that carries a length of wire rope 16. A drive tube 19 is positioned vertically in the leaders with its bottom initially on grade 20. A charge of dry concrete is dumped into the bottom of the drive tube to be formed into a plug 22, by means of a ram or drop-weight 24, which typically weighs about 7,000 pounds and is normally about 12 inches in diameter and about 19 feet long. Typical drive tubes have an inside diameter which varies from about 16 to about 20 inches, for example. The wire rope 16 is led from the drum 14 over a headblock 26, down to a swivel assembly 28 for connecting the end thereof to the top of the drop-weight 24.

Figures 3, 4, 5:
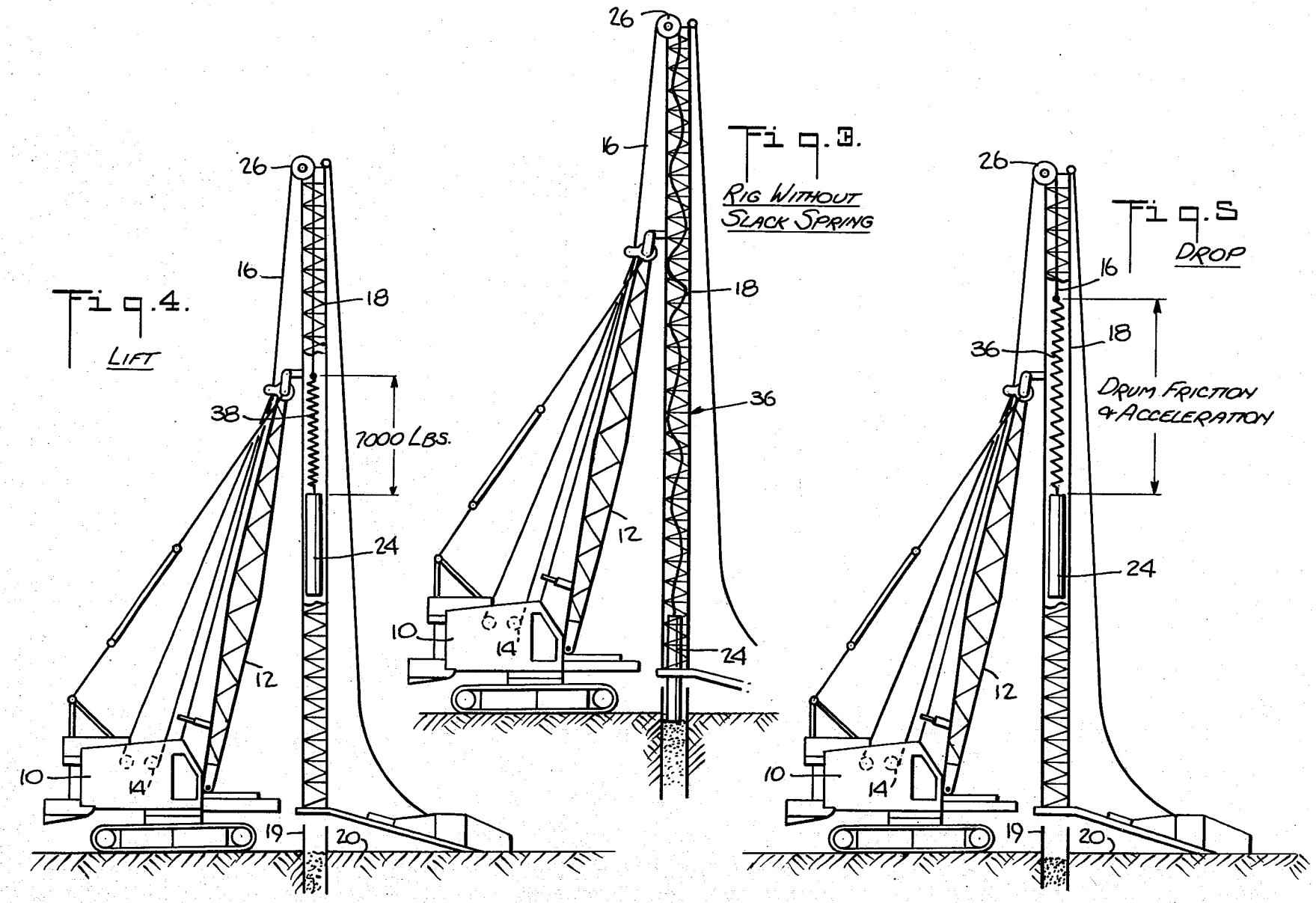
FIG. 3 is a side elevation of a hammer rig drawn to a reduced scale, showing the prior art.
FIG. 4 is a side elevation of a bulb pile hammer rig, drawn to a reduced scale showing the lift operation of the drop-weight.
FIG. 5 is a side elevation similar to FIG. 4, but showing the rig during dropping of the drop-weight.
Figure 7:
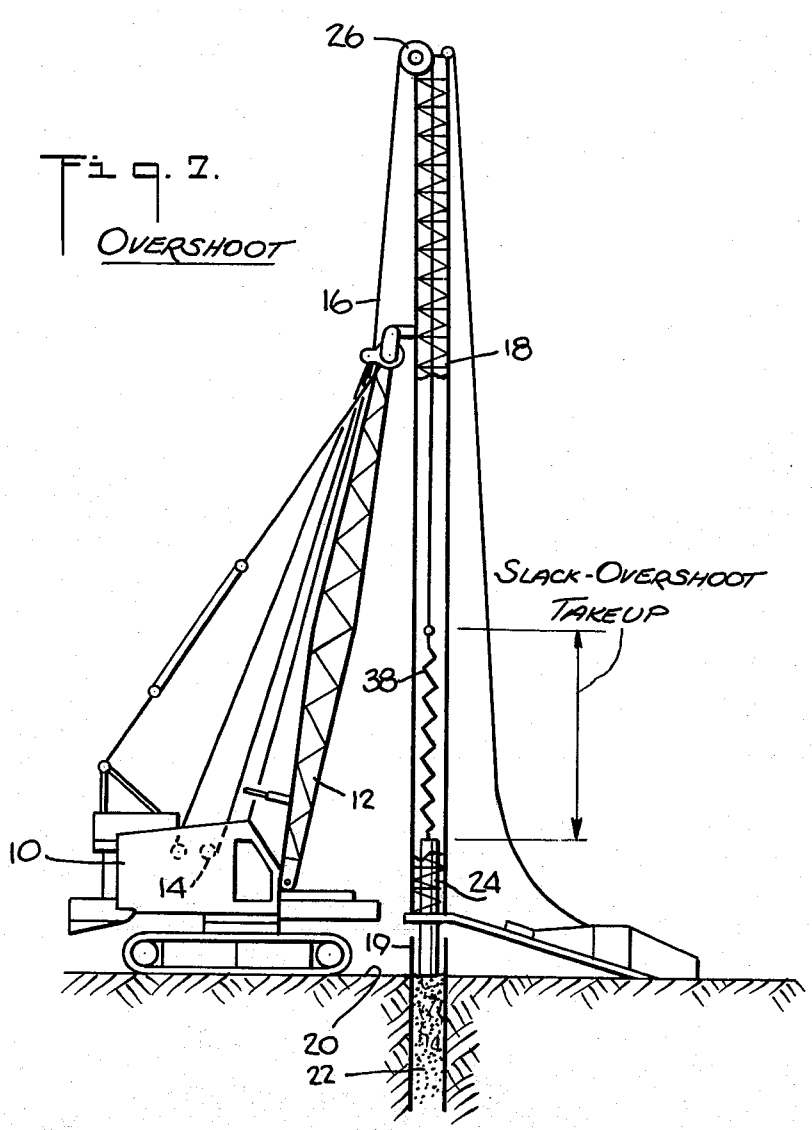
FIG. 7 is a side elevation similar to FIGS. 4, 5 and 6, but showing the rig subsequent to impact.
Figure 6:
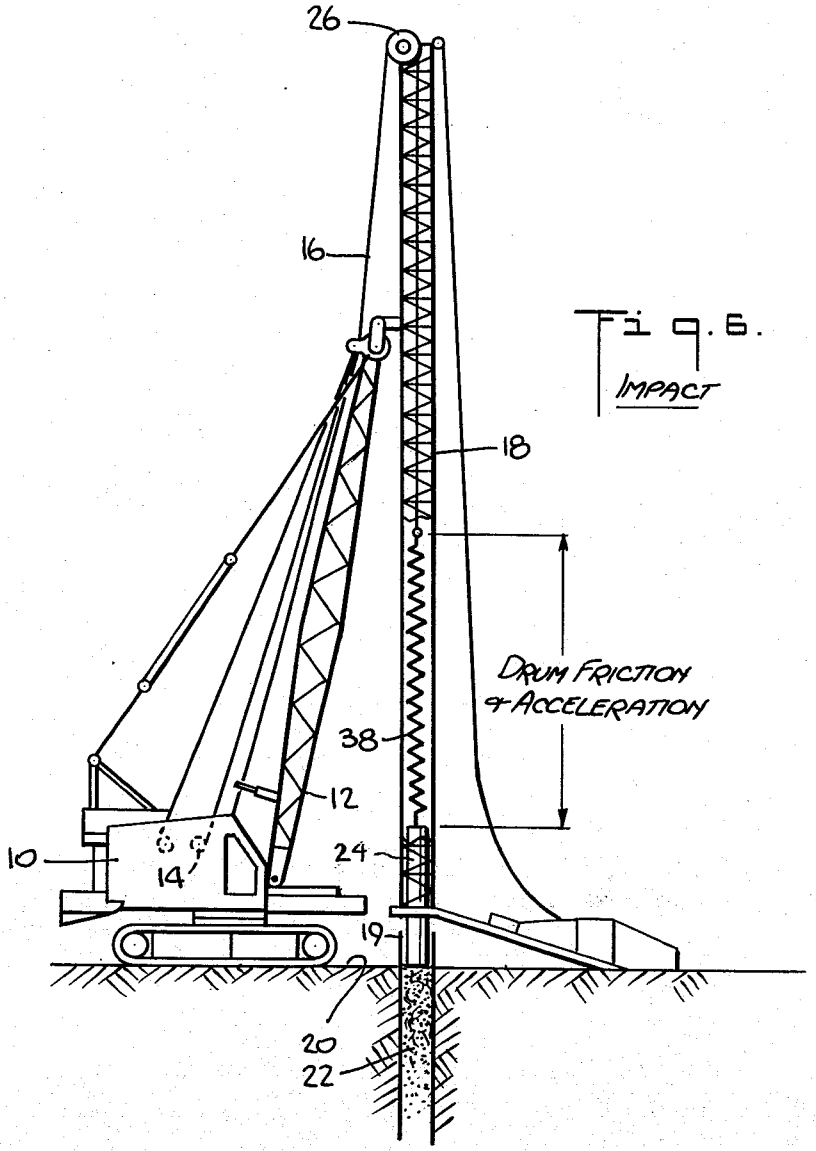
FIG. 6 is a side elevation similar to FIGS. 4 and 5, but showing the drop-weight at impact.

In operation, the drop-weight 24 is lifted by the wire rope 16 by winding the drum 14, which is driven by a motor 30 through clutch means 32, FIG. 2, and then is allowed to fall freely by releasing the clutch means 32. This cycle of operation is continuously repeated for forming the plug in the bottom of the open ended drive tube which is utilized to drive the tube into the ground and thence to compact and extrude additional concrete below the end of the tube for forming an expanded base. Various lengths of drops are used with the maximum normally being about 20 feet. During the drop the drum 14 is accelerated to a rotational speed dictated by the velocity of the drop-weight 24, and at the moment of impact, the operator applies a drum brake 34, FIG. 2, to bring the drum to rest. The amount of rotation of the drum after impact results in accumulation of slack in the rope, which results in damaging effects thereon. FIG. 3 illustrates the accumulation of slack, as indicated at 36. In order to take-up this over-travel, a spring system is employed adjacent the upper end of the drop-weight as indicated at 38, FIGS. 4 to 7, or in the swivel assembly 28, as indicated at 40, FIG. 1, FIGS. 4 to 7 illustrate the effects of the spring system 38 during the various steps of the operational cycle. Thus, FIG. 4 shows the spring in its compressed condition during the lifting phase of the operation, wherein it is loaded to about 7,000 pounds due to the weight of the drop-weight 24. In FIG. 5, the weight is falling freely so that the spring 38 is subjected to a load produced by the drum friction and acceleration. FIG. 6 shows the rig at the time of impact wherein the spring is still subjected to drum friction and acceleration. FIG. 7 shows the spring when it is taking-up the slack overshot in the rope.

Figure 8:
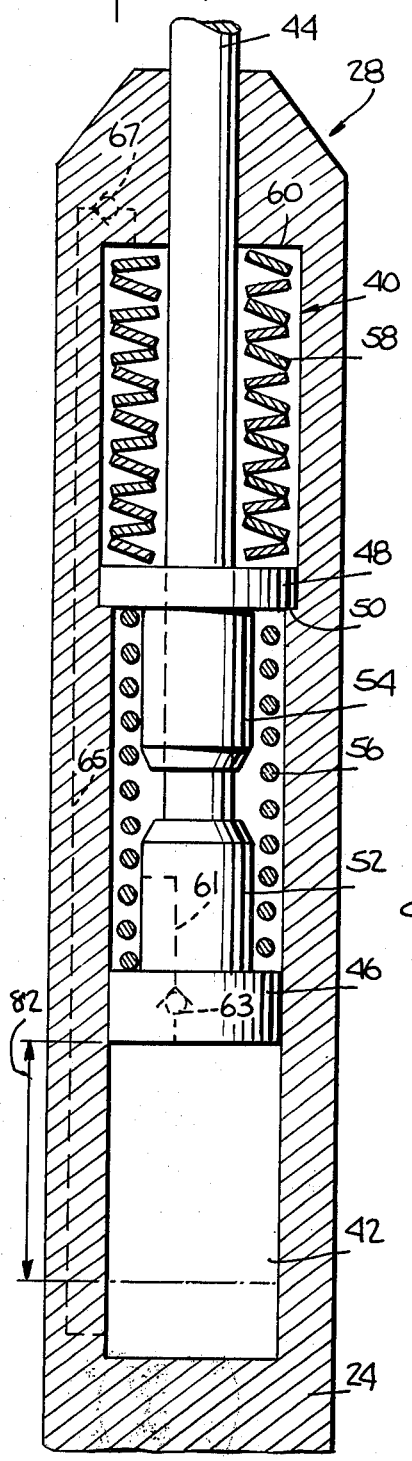
FIG. 8 is a medial, vertical, sectional view of a swivel for use with a bulb pile hammer rig, showing a compound spring arrangement constructed in accordance with one aspect of my invention, the compound spring arrangement being shown during drop of the drop-weight.
Figure 9:
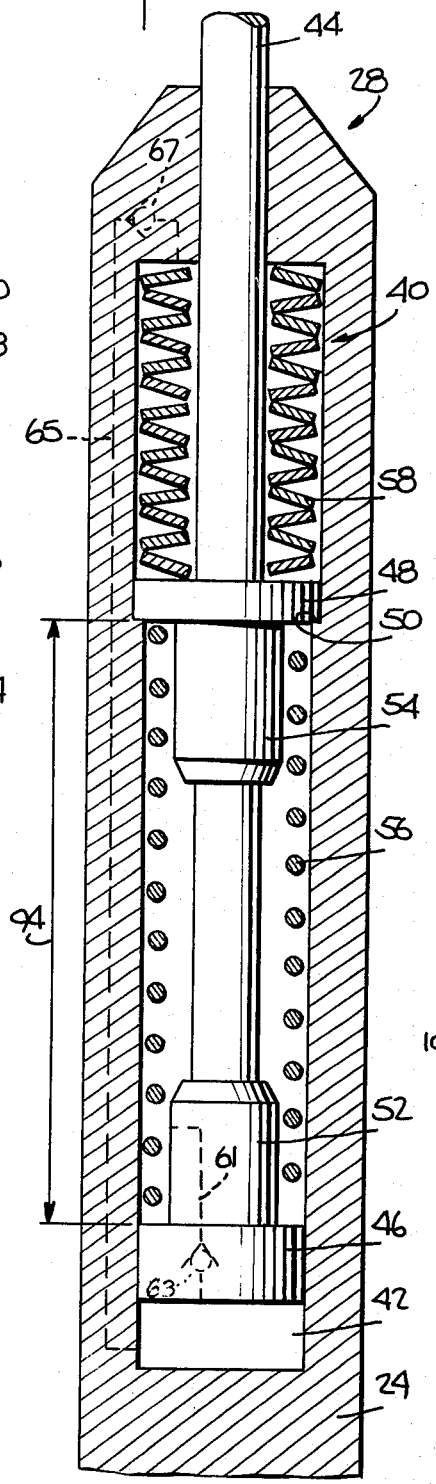
FIG. 9 is a medial, vertical, sectional view similar to FIG. 8, but showing the compound spring system at extreme overtravel subsequent to impact.
Figure 10:
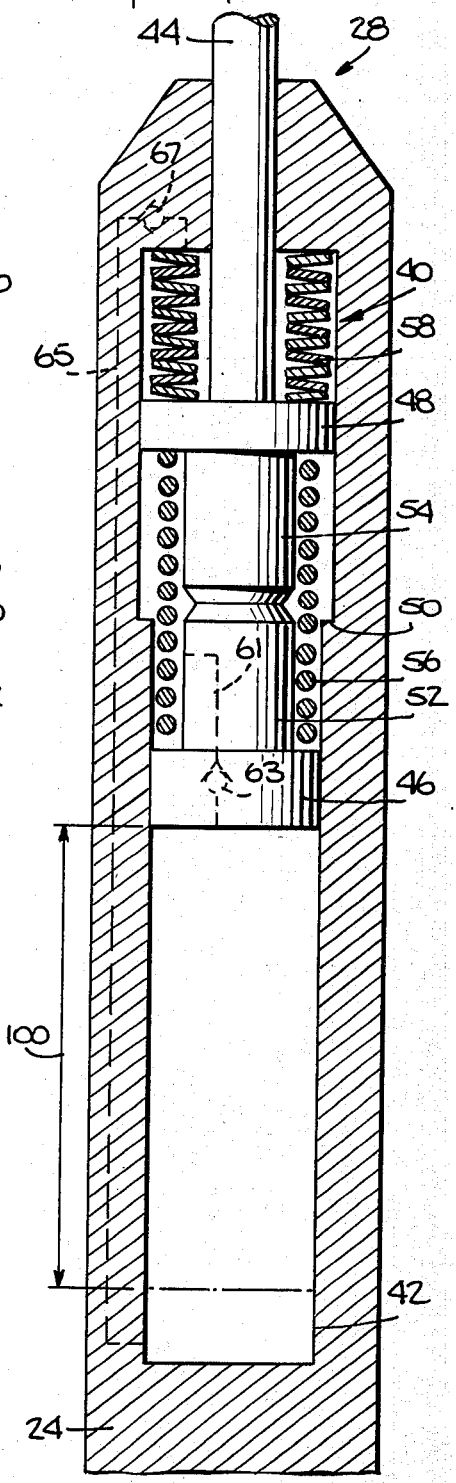
FIG. 10 is a medial, vertical, sectional view similar to FIGS. 8 and 9, but showing the compound spring arrangement at maximum cable tension during beginning of upstroke of the drop-weight.

It has been found that a conventional spring is not fully effective for taking care of the over-travel, as the spring would be under its lightest loading at the moment of impact, and hence, would not have much free travel left to handle over-travel unless it was excessively long and in which case it would undergo excessive deflection under the hoisting load. To overcome this problem, I provide a compound spring arrangement, as illustrated in FIGS. 8 to 10, which show the arrangement, generally indicated at 40, installed in the swivel 28. The upper end of the body of the drop-weight 24 is provided with a piston cylinder 42 in which is mounted a piston rod 44 carrying at the lower end thereof a lower piston 46, the upper end of the rod being attached to the wire rope 16. An upper piston 48 is slidably mounted on the rod 44 and a fixed stop 50 is provided in the cylinder in the drop-weight to limit the lower travel thereof. The lower piston 46 carries an upwardly extending sleeve 52 and the upper piston 48 carries a downwardly extending sleeve 54 which coact to guide a lower spring 56 interposed between the two pistons. An upper spring 58 is interposed between the upper piston 48 and an upper fixed stop 60 provided at the top of the cylinder in the drop-weight. A connecting passage 61 having a ball check valve 63 interconnects the lower portion of the cylinder 42 with the area thereof above the lower piston 46 so that a flow of oil can pass from above the piston to below the piston, but not in the opposite direction. A second connecting passage 65 with a ball check valve 67 serves to allow oil to flow from the lower portion of the cylinder 42 below the lower piston 46 to the top of the cylinder adjacent the top of the upper spring 58, but prevents flow in the opposite direction. This hydraulic system serves to cushion the movement of the pistons and the rod 46 towards the lower and upper ends of their strokes, respectively. Thus, during downward movement of the piston 46 oil is forced upwardly through the passage 65 and check valve 67. During upward movement of the pistons 46 and 48, the oil flows downwardly past the upper spring 58, past the upper piston 48, past the lower spring 56 and through the passage 61 past the check valve 63 to the lower portion of the cylinder 42. In addition, the flow of oil serves to lubricate all of the moving parts in the device.

An example of the operation characteristics of the bulb pile hammer rig is shown in FIGS. 11 to 13, when employing the compound spring arrangement as illustrated in FIGS. 8 to 10. The spring characteristics are illustrated in FIG. 12 wherein the length to force relationship of the spring 56 is indicated at 62 and the length to force relationship of the spring 58 is indicated at 64. It is assumed that the rope can be stopped in three feet from the moment of brake application and that the rate of deceleration is uniform. Referring to FIG. 11, a time displacement curve for the drop-weight is shown in solid line, and a time displacement curve for the rope is shown in broken line. At the top of the drop-weight stroke, the rope and the drop-weight are positioned as indicated at 66 and 68, respectively. The clutch 32 on the drum 14, FIG. 1, is released and the drop-weight commences its free fall, accelerating at a rate of about 29.8 feet/ sec.$^2$. The compound spring at this time is as shown in FIG. 8, the lower spring having moved upwardly about 3 inches as indicated at 82. I have discovered that it is very advantageous to commence the deceleration of the rope prior to impact, thereby compressing the spring. One advantage is that it reduces the amount of over-travel so that only a small amount thereof need be compensated for, and in addition, less cycle time is required between impacts. Thus, when the rope reaches the point indicated at 70, the brake 34, FIG. 2, is applied to the drum, as by means of solenoid valve 35, to decelerate the rope. The spring compression at this time is 0.25 feet, as indicated at 72 in FIG. 11, due to the drag, and drum and cable acceleration. This point is indicated at 74 in FIG. 13. At the moment of impact the rope position is indicated at 78 and the drop-weight position is indicated at 80 with the elapsed time from the beginning of the fall being 1.16 seconds and the elapsed time from the initiation of the breaking action being 0.08 seconds. The maximum relative movement of the stem in the drop-weight is 0.85 feet as indicated at 76, FIG. 11. The position of the compound spring arrangement at the moment of impact is similar to that shown in FIG. 8, except that the lower spring is further compressed and the upper spring is not compressed, with the force acting upwardly on the rod 44 being about 2,000 kips or two kips. The energy absorbed by the drum brake during stopping due to the compound spring system is shown in FIG. 13, with the drag of the rope system being assumed to be about 0.5 kips at the moment of brake application and dropping to substantially zero after 3 feet of rope travel as indicated by the drag line 84 in FIG. 13. The rope tension increases upwardly along the curve indicated at 86 and reaches a maximum of two kips after travelling about 2.15 feet at the moment of impact as indicated at 88. At the time interval of about 0.10 seconds after impact or after about 1.26 seconds after the beginning of the drop-weight free fall, the rope has moved about 3 feet subsequent to the application of the brake and its position is indicated at 90 in FIG. 11 and the position of the drop-weight is indicated at 92. The distance between the point 90 and the point 92 represents the deflection of spring 56 at the time both the rope and the drop weight have come to rest following impact. In the example shown in FIG. 11 this distance would be zero if the drop weight had stopped instantly on impact and this is an impossibility. In actuality it represents the distance traveled by the weight after impact. The residual force in spring 56 and hence the tension in the rope is also proportional to this distance. It can be seen that this value is controllable by controlling the time of brake application relative to the moment of impact. It is the intent of this invention that this timing be so controlled that the spring 56 just reaches full extension and hence line tension just drops to zero at the moment the rope is brought to rest. Any deviation from this should be in the direction of maintaining some deflection in the spring and residual tension in the rope. In this way the formation of damaging slack is avoided. FIG. 13 represents the above described condition. As shown, the rope tension increased along the curve indicated at 96 to a maximum at point 88 at the moment of impact, then decreased along the curve indicated at 96 to substantially zero tension. Thus, the energy absorbed, indicated at 98, by the drum brake during stopping due to the compound spring system is the area encompassed by the curves 84, 86 and 96. Accordingly, it should be appreciated that the wire rope remains in tension throughout the impact period. The significance of this system as compared to the non-sprung over-travel swivel is that the axial motion in the swivel is less than one-third of the potential over-travel of the line. It is dependent, however, on being able to accurately control the moment of brake application relative to impact. The partial compression of the spring prior to impact absorbs some of the blow energy of the drop-weight, but in the example described this could be compensated for by increasing the drop by 3 inches. What is surprising about the invention is that even though the brake is applied in advance of impact, the amount of energy actually lost to the spring is much less than might be expected. Accordingly, the reversal of the stress in the rope is substantially eliminated and the line is kept under tension continuously, thereby substantially increasing the life of the wire rope at the drum, headblock and swivel.

Thereafter, the brake is released and the clutch is re-engaged and lifting of the drop-weight is commenced. During the upward acceleration of the drop-weight spring 56 first is compressed along the line 62 of FIG. 12 until sleeves 52 and 54 come in contact. Spring 58 then commences to compress along the line 64. When the load in spring 58 reaches 7,000 pounds the weight commences to accelerate upward until the spring force on the rod 44 of FIG. 10 reaches about 15,000 pounds or 15 kips, which is the maximum cable tension during upward acceleration of the drop-weight, as is illustrated in FIG. 10, the compression of 1.5 feet being indicated at 100, and the 15,000 lb. upward force on the rod 44 being absorbed by the spring 58. The rope moves upwardly until it reaches a linear speed of about 4 feet per second as indicated at 102, FIG. 11, at which time the spring compression reduces to about 7,000 pounds or 7 kips as indicated at 104, FIG. 11. The behavior of the drop-weight during this upward acceleration is schematically illustrated at 106. However, the actual behavior is not truly shown as this must be determined by step integration. Thus, it will be seen that in a system as illustrated, the reversal of stress in the line is substantially eliminated and the line is kept under tension continuously, thereby substantially improving the life of the rope at the drum, headblock and swivel.

Next, turning to FIG. 14, there is shown an over-travel swivel assembly for a bulb pile hammer rig which includes a recess 108 in the upper portion of the body of the drop-weight 24, having a replaceable sleeve 110 locked in position by set screws 111, dowels or the like. A piston rod 112, which is connectable to the wire rope by a head portion 115 at the upper end thereof as at 114, carries a plunger piston 116 at the lower end thereof, which is adapted to slide longitudinally in the sleeve 110. A cap member 120 is threadably secured to the upper end of the body of the drop-weight and is provided with a rod wiper and seal member 122 and a replaceable bushing 124 for sealing the recess 108 in the upper end of the drop-weight. A rubber baffle or collar 118 is provided under the head 115 to protect the rod and seal. A ring member 126 is mounted at the upper end of the sleeve 110 in order to coact with the cap member 120 to hold disc springs 128 therebetween in order to accelerate the drop-weight to maximum line speed without bottoming. A thrust washer 129 is mounted on the top of the plunger piston 116 for engaging the ring member 126 at the upper portion of the piston's stroke to compress the disc springs 128.

The lower portion of the plunger piston is of downwardly, inwardly converging configuration and the lower portion of the sleeve 110 is provided with a generally mating configuration. The lower portion of the sleeve forms an oil reservoir 130, the oil level 132 being adjusted so that the plunger strikes the surface often enough to lubricate the thrust washer and springs by means of splash action. The maximum lower stroke of the plunger piston is illustrated in FIG. 14 by the broken lines, as at 116', the piston being cushioned by the oil trapped in the bottom of the cylinder in the event of over-travel on the down stroke. The plunger piston rod 112 is provided with a longitudinally extending medial bore 134 which extends the entire length thereof and a filler plug 136 is provided at the top. Oil level gauging plugs 138 are provided at spaced intervals through the wall of the drop-weight body for indicating the oil level in the recess, and a drain plug 140 is provided at the bottom of the reservoir.

Details of the operational characteristics of the plunger piston 116 are shown in FIGS. 15 to 17. During the down stroke, increased air pressure accumulates under the plunger piston which causes the thrust washer 129 to be lifted off the upper surface of the plunger piston, as seen in FIG. 15. When the plunger piston strikes the oil, oil passes upwardly through oil jet passages 142 and out through oil jets 144 against the walls of the sleeve 110 as at 146, FIG. 16. As the thrust washer 129 falls, it by-passes oil adjacent the wall due to the large clearance 148 between the outside diameter of the thrust washer and the inside diameter of the sleeve 110. During the upstroke of the plunger piston, as seen in FIG. 17, the jets 144 and jet passages 142 are blocked off by the thrust washer 129 and oil collects on top of the washer as indicated at 150 in FIG. 17. Drain passages 152 are provided in the plunger piston rod which extend from the outside surface to the longitudinal bore 134 in order to allow the excess oil to drain back to the reservoir 130 and thereby prevent blow-out of the rod seal. Thus, in operation for most blows of the drop-weight, the plunger piston dips into the oil in the reservoir at the bottom of the sleeve which causes the oil to squirt up through the oil jet passages 142 and out through the oil jets 144 to replenish the lubrication of the thrust washer. With this washer reseated on the upstroke, it traps some oil on its upper side. However, the clearances are such that all free oil drains back down during one cycle. In the event of excess over-travel the plunger piston is cushioned by the oil trapped in the bottom of the cylinder. When the plunger piston reaches the top of its stroke, it commences to pick-up the drop-weight on the stack of disc springs. Knowing the maximum line speed of the hoist, these springs are so arranged that the drop-weight is accelerated to line speed before they bottom out, thereby eliminating solid impact. During the over-travel period the thrust washers are completely unloaded, so that the only rotational resistance is that on the sides of the rod and plunger piston. There is about a 5 p.s.i. pressure change inside the sleeve which induces some breathing past the rod wiper and seal, but is a very moderate pressure to seal against. The device is therefore self-lubricating. The oil is replenished or renewed by means of the filler and drain plugs.

FIGS. 18 and 19 illustrate two aspects, which are taken into account in selecting the plunger piston. That is, as shown in FIG. 18 the dimensions of the plunger piston should preferably be so selected that the upper end of the plunger piston rod 112, when fully extended, cannot strike the wall of the drive tube 18 in which it is being used. Next, as illustrated in FIG. 19, the piston rod should preferably have sufficient strength so that the weight of the drop-weight 24 as indicated at W, may be lifted from a horizontal position by means of the wire rope 16 by a force indicated at F without over-stressing any of the components of the swivel.

Figure 20:
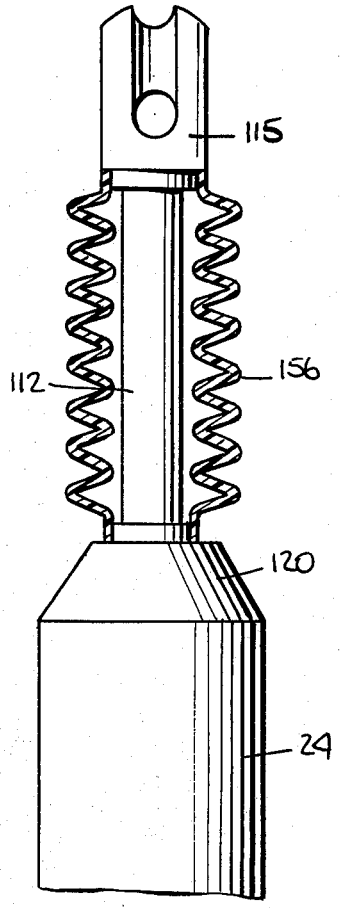
FIG. 20 is a side elevation, partially in section, of a bellows-type sleeve for protecting the rod and excluding foreign matter from the seal area of a swivel, the bellows-type sleeve being shown in its expanded position.
Figure 21:
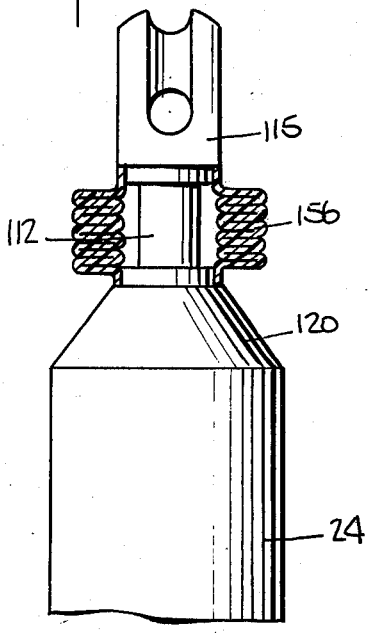
FIG. 21 is a side elevation, partially in section, of the bellows-type sleeve shown in FIG. 20, but showing the bellows-type sleeve in its contracted position.

The rubber baffle 118, FIG. 14, mounted under the head 115, serves as one means of protecting the plunger piston rod and rod seal. Additional means for protecting the rod and excluding foreign matter from the seal area are shown in FIGS. 20 to 25. A bellows-type sleeve 156 of flexible material is interposed between the head 115 of the plunger piston rod 112 and the cap 120 mounted on top of the drop-weight 24, FIG. 20 showing the bellows in its extended position and FIG. 21 showing it in its contracted position.

Figure 22:
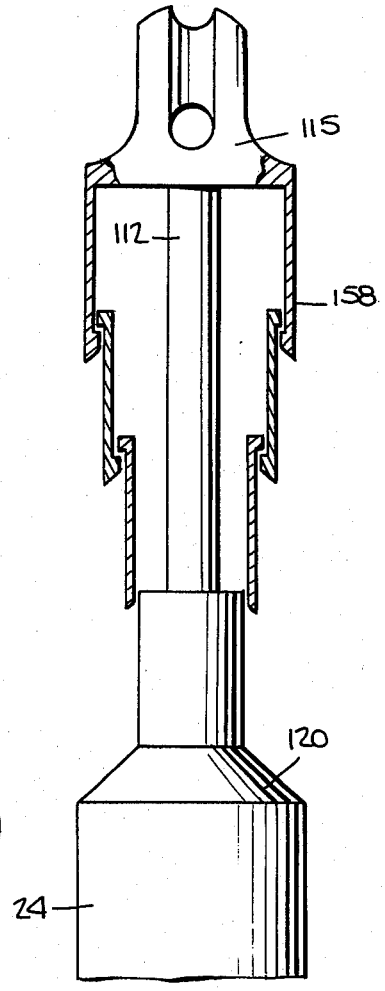
FIG. 22 is a side elevation, partially in section, of multiple telescoping sleeves for protecting the rod, and excluding foreign matter in the seal area of a swivel, the sleeves being shown in their expanded positions.
Figure 23:
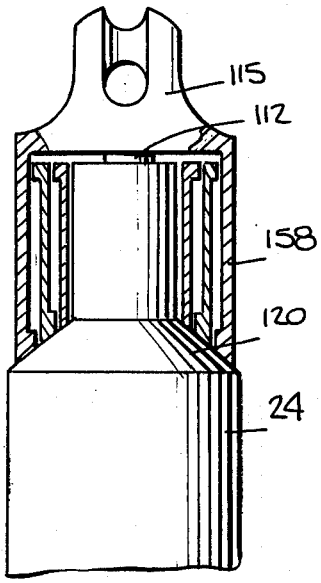
FIG. 23 is a view of the multiple telescoping sleeves of FIG. 22, but showing the telescoping sleeves in their contracted positions.

FIGS. 22 and 23 show multiple telescoping sleeves 158 interposed between the head 115 of the plunger piston rod 112 and the cap 120 on top of the drop-weight 24, FIG. 22 showing the sleeves in their extended positions and FIG. 23 showing them in their retracted positions.

Figure 24:
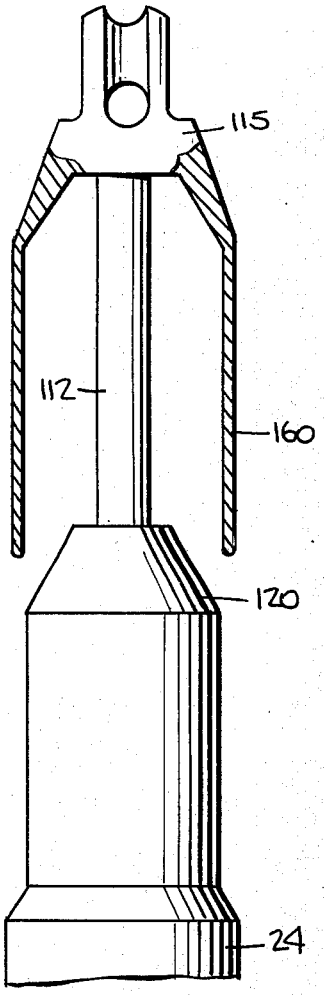
FIG. 24 is a solid bonnet telescoping arrangement for protecting the rod and excluding foreign matter from the seal area of a swivel, the arrangement being shown in its expanded position.
Figure 25:
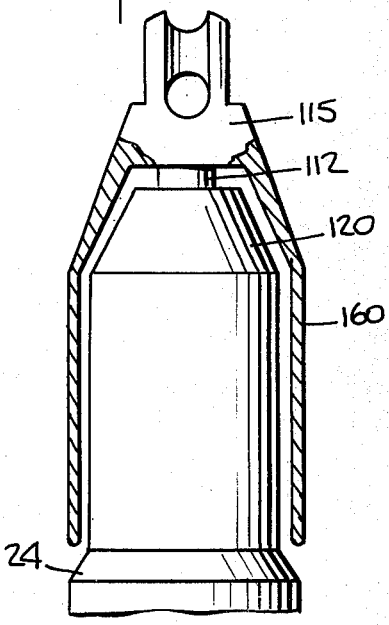
FIG. 25 is a view similar to FIG. 24, but showing the solid bonnet telescoping arrangement in its contracted position.
Figure 2B:
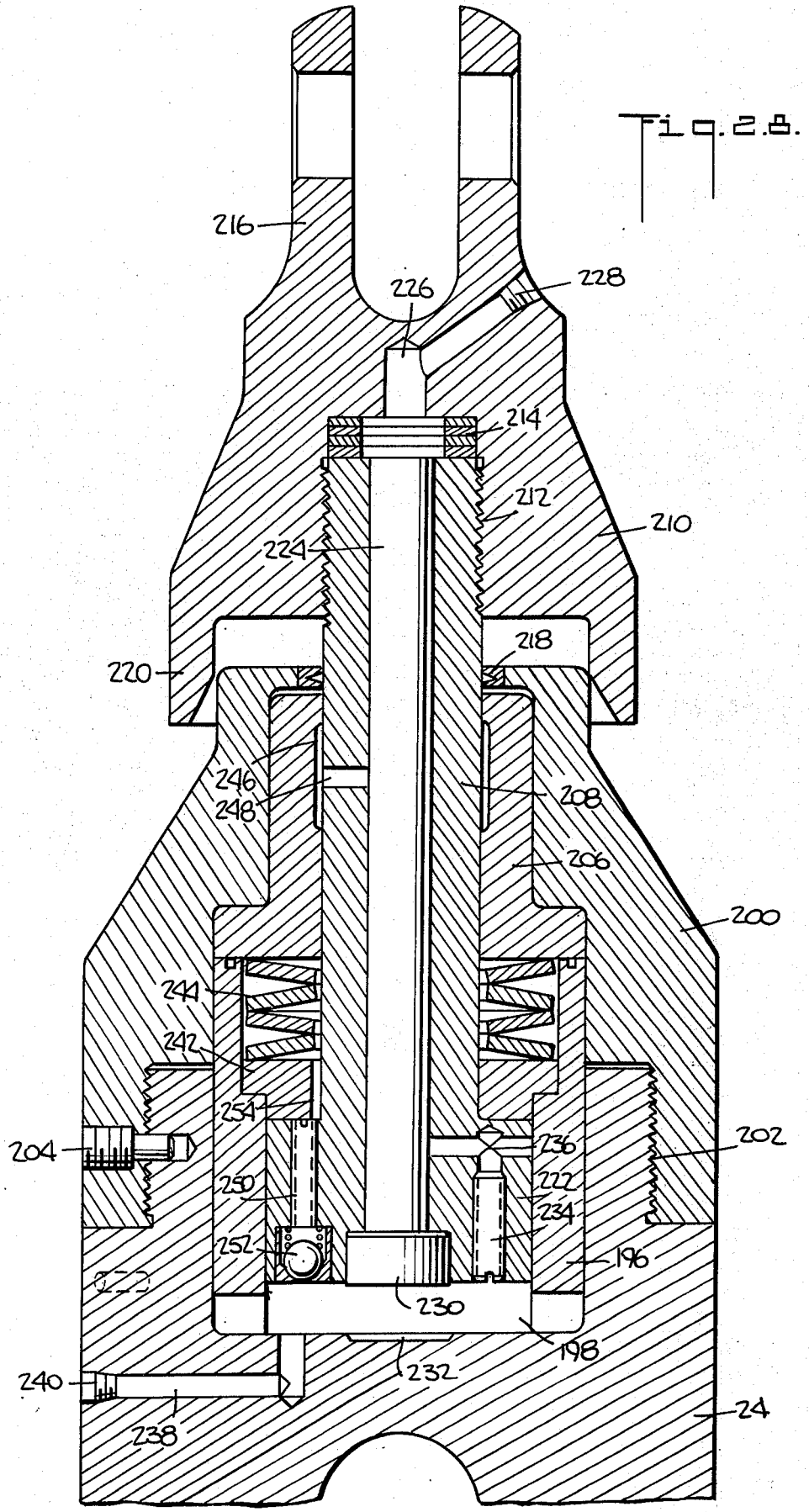

As shown in FIGS. 24 and 25, a solid bonnet 160 is mounted on the bottom of the head 115 of the plunger piston rod 112 and extends downwardly to override the cap member 120 at the top of the drop-weight 24, FIG. 24, showing the swivel in its extended position, while FIG. 25 shows the swivel in its contracted position.

Referring next to FIGS. 26 and 27, there is shown another embodiment of a hydraulic over-travel swivel device for use with a bulb pile hammer rig. The swivel assembly includes a lower recess forming a pump cylinder 162 at the upper end of the drop-weight 24 in which is mounted for reciprocation a pump piston 164 and a spring 166 for resiliently urging the pump piston to its uppermost position. A spring loaded ball check valve 168 is medially mounted on the vertical axis within the pump position in order to allow oil to flow downwardly through a pump piston passage 170 and to prevent oil from flowing upwardly in said passage. Under the pump cylinder 162 and in fluid flow communication therewith is a pump cavity 172. Above the lower pump cylinder 162 is a second recess or plunger piston cylinder 174 in which is mounted for reciprocation a plunger piston rod 176 carrying a plunger piston 178. The lower portion of this cylinder forms an oil reservoir 180, which has downwardly, inwardly, tapered side walls that correspond to a downwardly, inwardly, tapered lower portion 182 of the plunger piston 178. The upper end of the piston rod 176 passes through sealing means 184 and is connected to the wire rope. A first connecting passage 186 connects the oil reservoir 180 with the pump cylinder 170 above the pump piston 164 and a second passage 188 connects the upper end of the piston cylinder 174 with the oil resrvoir 180, and a third passage 190 connects the upper end of the piston cylinder 174 with the pump cavity 172. The oil reservoir 180 and the pump cavity 172 as well as the lower portion of the pump cylinder 162 are filled with oil. At the time of impact of the drop-weight 24, the momentum of the pump piston 164 which has substantial mass forces it towards the bottom of the cylinder 162 thereby forcing oil up through the passage 190 to replenish the oil on the upper side of the plunger 178. After impact the plunger 178 moves rapidly downwardly so that the lower portion 182 enters the oil reservoir 180 to cushion impact of the plunger piston, the lower portion 182 and the walls of the oil reservoir 180 being so sized that the lower portion of the plunger piston is carried on a layer of oil even at the bottom of its stroke. The entry of the plunger piston into the oil reservoir 180 forces oil downwardly through the first connecting passage 186 into the top of the pump cylinder 162, thereby forcing oil into the pump cylinder where it is free to pass through check valve 168 and be forced up passage 192 to further replenish oil supply in the upper end of the cylinder 174. In addition, movement of the plunger piston into the oil reservoir 180, forces oil upwardly through the second passage 188 to the upper end of the piston cylinder 174. The significance of the pump constituted by cylinder 162 and piston 164 is that there is assured a supply of oil above the plunger piston 178 with each blow of the drop-weight regardless of how far the plunger piston over-travels.

During the up and down stroke of the drop-weight, i.e. except at the time of impact, the spring 166 moves the pump piston 164 upwardly to its uppermost position and the check valve 168 allows oil to flow from above the pump piston down into the pump cavity 172.

In operation, during the upstroke of the drop-weight, the plunger piston 178 moves upwardly. As the piston approaches the top of its stroke an enlarged portion 192 thereof enters a tapered cup 194 at the top of the plunger piston cylinder 174, thereby restricting the area through which the oil can escape and causing a buildup of pressure, as best seen in FIG. 27. At this time some oil is forced back down the third passage 190 to the pump cavity 172, and some oil is forced down the second passage 188 to the oil reservoir 180. At a certain point the pressure becomes sufficient to raise the drop-weight and starts its upward stroke. This smooths out the application of the load to the rope and reduces the shock loading effects. The clearance between the top of the plunger piston and the cup 194 are selected so that the weight is raised to its full height before the plunger piston completely bottoms out in the top of the cylinder, and hence, the weight is carried on fluid as compared to metal to metal contact, thereby eliminating wear and reducing rotary friction. It is noted that at the moment of impact, the plunger piston is free to move downwardly because air can circulate through the second passage 188, thereby breaking the suction effect at the top of the plunger piston stroke.

It will be appreciated that the prior art practice was to use a swivel connection between the wire rope and the drop-weight, and it has been observed that the rope life improves with the freedom with which the swivel rotates. However, in conventional swivels, the load bearing surfaces are relatively exposed to contamination and frequent manual lubrication was necessary to keep them operative. On the other hand, according to the present invention a relatively large supply of lubricating oil is employed and the only contamination is that which can find its way past the rod seal, and consequently, the device is operable over long periods of time without replenishment of the oil.

Referring next to FIG. 28 of the drawings, there is shown an over-travel swivel for a bulb pile hammer rig which includes a drop-weight 24 having a recess at the upper end thereof for receiving a cylinder sleeve 196 to form a piston cylinder 198. A cap member 200 is threadably mounted on the top of the drop-weight 24, as at 202, and is lockable in position by a set screw 204. A guide bushing 206 is mounted in the cap and a plunger piston rod 208 is slidably mounted therein. A bonnet 210 is threadably connected to the upper end of the rod, as at 212, and sealing means 214 serve to prevent leakage of oil along the threads. The upper end of the bonnet is in the form of a head 216 to which is connected the wire rope. Sealing means 218 are interposed between the cap member 201 and the rod 208 and the bonnet 210 is provided with an apron portion 220 for protecting the piston rod and rod seal by excluding foreign matter from the seal area.

Still referring to FIG. 28, the piston rod 208 carries at the lower end thereof a plunger piston 222 which has a sliding fit with the cylinder sleeve 196. The piston rod 208 and the plunger piston 222 are provided with a central bore 224, which extends from towards the bottom end upwardly to the top end where it mates with a filling passage 226, that is closeable as by means of a filling plug 228, for example. The bottom of the bore is closed by a protruding plug portion 230 which is receivable in a corresponding recess 232 located in the bottom of the piston cylinder 198. Interconnecting the bore 224 and the bottom of the cylinder 198 is a passage 234 containing an orifice 236. A drain passage 238 extends from the bottom of the cylinder 198 and is closeable by a drain plug 240. Mounted on the top of the plunger piston 222 is a thrust washer 242, and a plurality of disc springs 244 are interposed between the washer 242 and the bottom face of the guide bushing 206. The bushing 206 is provided with an annular recess 246 and the piston rod 208 includes a radial passage 248 that interconnects the recess with the central bore 224. The piston 222 is also provided with a passage 250 which includes a spring loaded ball check valve 252 so that oil may pass upwardly from the lower portion of the piston cylinder 198 through the passage to an area just below the thrust washer 242, the thrust washer 242 being provided with a mating recess 254 to allow the oil to pass upwardly into the area of the disc springs 244.

In operation, when the drop-weight is hanging free, the oil level in the system is about midway up the central bore in the piston 208 with the lower portion of the piston cylinder 198 being completed filled. At this time the disc springs 244 are compressed to approximately one-half their height by the weight of the drop-weight. During the free-fall of the drop-weight, the disc springs extend thereby urging the piston 222 downwardly to its position as seen in FIG. 28. At the moment of impact of the drop-weight, the oil in the piston cylinder 198 under the piston 222 is compressed and forced upwardly through the check valve 252, passage 250 and mating recess 254, as well as upwardly through the passage 234, orifice 236 to the bore 224. These passages are so sized that the piston normally comes to rest before striking the bottom of the piston cylinder. However, if the piston should over-travel, oil would be trapped in the recess 232 located in the bottom of the piston cylinder 198 to thereby cushion the shock.

In operation, as the drop-weight is hoisted, the oil above the piston 222 is pressurized as it carries the weight of the drop-weight plus the accelerating upforce. The oil can only escape by leaking through the clearance between the piston and the cylinder sleeve 196 and the guide bushing 206. The clearances are so sized that the piston will return to approximately the position shown in FIG. 28 during a 20 foot lift. The oil that leaks upwardly flows through the annular recess 246 and the radial passage 248 back into the central bore 224, while the oil that leaks downwardly returns directly to the cylinder 198 below the piston. Also, the oil is free to flow downwardly through the passage 234. If the piston should reach the position as illustrated in FIG. 28, before the drop-weight reaches the top of its stroke, the thrust washer 242 will begin to pick-up some of the load and the disc springs 244 will be compressed. In view of the fact that this normally does not occur until the upward acceleration force has diminished, i.e. the upward movement of the drop-weight has steadied to a uniform velocity, the springs will only compress to about half their height, as at the beginning of the cycle.

Whatever air is in the system will alternately be compressed and expanded and since the seal means 218 is selected so as to resist inwardly directed flow but allow outwardly directed flow, a partial vacuum will develop inside the swivel apparatus. However, with the oil level at about mid-height of the central bore 224, the pressure differential will not exceed about 9 p.s.i. It will be appreciated that the swivel apparatus does not depend upon the functioning of the seal 218 to operate, the seal being primarily to exclude contamination. The contamination which does enter the system will tend to be carried into the central bore 224 by the upward flow, where it will have a change of settling out in the dead area at the bottom of this reservoir. In addition, the system can be flushed by removing the drain plug 240 and forcing oil in the filler pipe 226, while working the piston up and down, but such flushing is infrequently necessary.

It will thus be seen that the swivel device maintains a condition of low rotary friction, especially when under load, which is effected primarily by causing the load to be carried on pressurized fluid during the upstroke or hoisting stage, and also during the period of impact when the dead weight of the rotating parts would otherwise impact against the body of the drop-weight. In addition, the swivel device is self-lubricating, which is effected by having the device contain a substantial reservoir of oil that is caused to continuously circulate past the working surfaces by reason of the reciprocating action caused by the lifting and dropping of the drop-weight on conjunction with the check valve arrangement. The only point of oil leakage from the system or for the entrance of contamination into the system is protected by sealing means. Next, the swivel device is shock resistant. The moving parts are protected from shock resulting from sudden stopping of the drop-weight at impact by being supported at that moment on a body of oil which must be expelled from a confined chamber. Likewise, the shock resulting from sudden tensioning of the cable when initiating the uplift phase, is absorbed by transmitting this load to another body of oil in a confined chamber. In the event that the moving parts should over-travel in the upward direction relative to the drop-weight, the load is transmitted to a spring system. Further, the swivel device has a long service life due to the copious lubrication, the minimizing of contamination, the flushing action of the forced oil circulation, the support of the major working loads on oil as compared to metal to metal contact, and the protection from shock, which all coact to minimize the wear and thereby prolong the life of the device.

Although certain particular embodiments of the invention are herein disclosed for purposes of explanation, various modifications thereof, after study of this specification, will be apparent to those skilled in the art to which the invention pertains.

What is claimed and desired to be secured by Letters Patent is:

1. A pile hammer rig comprising, a crane, a hoisting drum carried by said crane, driving means and braking means for said drum, a drop-weight, a hoisting rope leading from said drum for lifting said drop-weight, a device for connecting said hoisting rope to said drop-weight including a rod and plunger piston assembly connected to said rope, means for connecting said rod and plunger piston assembly to the upper end of said drop-weight for movement between an upper position and a lower position with respect to said drop-weight, means for absorbing shock of said rod and plunger piston assembly when it approaches its upper position, and means for absorbing shock of said rod and plunger piston assembly when it approaches its lower position.

2. A pile hammer rig comprising, a crane, a hoisting drum carried by said crane, driving means and braking means for said drum, a drop-weight, a hoisting rope leading from said drum for lifting said drop-weight, a device for connecting said hoisting rope to said drop-weight including a substantially vertically extending rod, the upper end of said rod being attached to said rope, a lower piston mounted on the lower end of said rod, an upper piston slidably mounted on said rod above said lower piston, means for limiting the lower travel of said upper piston with respect to said drop-weight, a lower spring interposed between said two pistons, an upper spring mounted on the top of said upper piston, means for holding the upper end of said spring in fixed position with respect to said drop-weight, the load-deflection charactristics of said lower spring being substantially greater than the load-deflection characteristics of said upper spring.

3. A pile hammer rig comprising a crane, a hoisting drum carried by said crane, driving means and braking means for said drum, a drop-weight, a hoisting rope leading from said drum for lifting said drop-weight, a device for connecting said hoisting rope to a drop-weight including a piston cylinder formed at the upper end of said drop-weight, a substantially vertically extending rod mounted in said cylinder, the upper end of said rod being attached to said rope, a lower piston mounted on the lower end of said rod, an upper piston slidably mounted on said rod, stop means mounted in said cylinder to limit the lower travel of said upper piston, a lower spring interposed between said two pistons, upper stop means disposed towards the top of said cylinder, an upper spring interposed between the upper piston and the upper stop means, the load-deflection characteristics of said lower spring being substantially greater than the load-deflection characteristics of said upper spring.

4. A pile hammer rig according to claim 3, further comprising a connecting passage having a check valve for the flow of oil from a location in said piston cylinder above lower piston to a location in said cylinder below said piston and a connecting passage having a check valve for the flow of oil from said cylinder below said lower piston to a location in said cylinder above said upper piston.

5. A pile hammer rig comprising, a crane, a hoisting drum carried by said crane, driving means and braking means for said drum, a drop-weight, a hoisting rope leading from said drum for lifting said drop-weight, a device for connecting said hoisting rope to said drop-weight including a piston cylinder formed at the upper end of said drop-weight, a substantially, vertically extending piston rod mounted in said cylinder, the upper end of said rod being attached to said rope, a plunger piston mounted on the lower end of said piston rod, a thrust washer positionable on the upper side of said plunger piston, cap means mounted over the upper end of said piston cylinder, said piston rod passing through said cap means and being in sealed relationship with respect thereto, a ring member mounted in said cylinder for vertical movement above said plunger piston, means for limiting the lower travel of said ring member, spring means interposed between said ring member and said cap means, said piston rod and plunger piston having a longitudinal bore openable at the upper end to the atmosphere and openable at the bottom end into said piston cylinder below said plunger piston, a radial drain passage extending from said bore to said piston cylinder above said plunger piston, said plunger piston having at least one passage connecting the portion of the cylinder below the plunger piston with the portion of the cylinder between said plunger piston and the thrust washer.

6. A pile hammer rig comprising, a crane, a hoisting drum carried by said crane, driving means and braking means for said drum, a drop-weight, a hoisting rope leading from said drum for lifting said drop-weight, a device for connecting said hoisting rope to said drop-weight including a piston cylinder formed at the upper end of said drop-weight, a substantially, vertically extending piston rod mounted in said cylinder, the upper end of said rod being attached to said rope, a plunger piston mounted on the lower end of said piston rod, a thrust washer positionable on the upper side of said plunger piston, and having substantial clearance with respect to the side walls of said cylinder, a cap member mounted over the upper end of said cylinder, said piston rod passing through a medial bore in said cap member and being in sealed relationship with respect to said cap member, a ring member mounted in said piston cylinder for vertical movement above said plunger piston, means for limiting the lower travel of said ring member, spring means interposed between said ring member and said cap member, said piston rod and plunger piston having a longitudinal bore openable at the upper end to the atmosphere and openable at the bottom end into said cylinder below said plunger piston, a radial drain passage extending from said bore to said piston cylinder above said plunger piston, said plunger piston having a lower inwardly, downwardly, tapered portion, said cylinder having a downwardly, inwardly, tapered bottom portion forming an oil reservoir for receiving said tapered portion of said plunger piston, said plunger piston having at least one passage extending from the surface of the lower tapered portion to a location in said piston cylinder between the top of said plunger piston and said thrust washer.

7. A pile hammer rig according to claim 6, further comprising baffle means for portecting the seal relationship of said piston rod with respect to said cap member.

8. A pile hammer rig comprising, a crane, a hoisting drum carried by said crane, driving means and braking means for said drum, a drop-weight, a hoisting rope leading from said drum for lifting said drop-weight, a device for connecting said hoisting rope to said drop-weight, including a piston cylinder formed at the upper end of said drop weight, a substantially vertically extending rod and piston assembly mounted in said cylinder, means connecting said rod and piston assembly to said drop-weight for movement between an upper position and a lower position with respect to said drop-weight, the upper end of said rod having a head portion for attaching to said rope, sealing means for said rod at the upper end of said cylinder, and means mounted adjacent said sealing means for excluding foreign matter from the sealing means, 9. A pile hammer rig according to claim 8 wherein said means mounted adjacent said sealing means for excluding foreign matter from the sealing means comprises a flexible bellows extending from said head portion of said rod to the upper end of said drop-weight.

10. A pile hammer rig according to claim 8 wherein said means mounted adjacent said sealing means for excluding foreign matter from the sealing means comprises multiple telescoping sleeves interposed between said head portion of said rod and the upper end of said drop-weight.

11. A pile hammer rig according to claim 8 wherein said means mounted adjacent said sealing means for excluding foreign matter from the sealing means comprises a bonnet extending downwardly from said heat portion of said rod to override the upper end of said drop-weight.

12. A pile hammer rig comprising, a crane, a hoisting drum carried by said crane, driving means and braking means for said drum, a drop-weight, a hoisting rope leading from said drum for lifting said drop-weight, a device for connecting said hoisting rope to said drop-weight, including a lower recess forming a pump cylinder at the upper end of the drop-weight, a pump piston mounted in said pump cylinder, means for resiliently urging said pump piston to its uppermost position, a passage in said pump piston including a check valve for the flow of oil from said pump cylinder above said pump piston to said cylinder below said pump piston, a piston cavity disposed above said pump cylinder, a piston rod carrying a piston slidably mounted in said piston cylinder, sealing means disposed at the upper end of said piston cylinder, said piston rod extending from said cylinder through said sealing means and being connectable to said rope, a first connecting passage connecting the bottom of the piston cylinder with the top of the pump cylinder, a second connecting passage connecting the upper end of the piston cylinder with the lower end of the piston cylinder, and a third passage connecting the upper end of the piston cylinder with the lower end of the pump cylinder.

13. A pile hammer rig comprising, a crane, a hoisting drum carried by said crane, driving means and braking means for said drum, a drop-weight, a hoisting rope leading from said drum for lifting said drop-weight, a device for connecting said hoisting rope to said drop-weight, including a pump cylinder formed at the upper end of the drop-weight, a pump piston mounted in said pump cylinder, spring means for resiliently urging said pump piston to its uppermost position, a passage in said pump piston including a check valve for the flow of oil from said pump cylinder above said pump piston to said cylinder below said pump piston, a piston cylinder disposed above said pump cylinder, a piston rod carrying a plunger piston slidably mounted in said piston cylinder, sealing means disposed at the upper end of said piston cylinder, the upper end of said piston rod extending from said cylinder through said sealing means connectable to said rope, the lower portion of said plunger piston having downwardly, inwardly, tapered walls, the lower portion of said piston cylinder having a downwardly, tapered wall portion for receiving the lower portion of said plunger piston at the lower end of the piston stroke, said plunger piston having an upper enlarged portion and said piston cylinder having upwardly, inwardly, tapering walls at the upper end thereof for receiving said enlarged portion at the upper end of the piston stroke, a first connecting passage connecting the bottom of the piston cylinder with the top of the pump cylinder, a second connecting passage connecting the upper end of the piston cylinder with the lower end of the piston cylinder above the downwardly, inwardly, tapered portion, and a third passage connecting the upper end of the piston cylinder with the lower end of the pump cylinder.

14. A pile hammer rig comprising, a crane, a hoisting drum carried by said crane, driving means and braking means for said drum, a drop-weight, a hoisting rope leading from said drum for lifting said drop-weight, a device for connecting said hoisting rope to said drop-weight, including a piston cylinder formed at the upper end of said drop-weight, a piston rod and carrying a piston at the lower end thereof slidably mounted in said piston cylinder, the upper end of said piston rod being connectable to said rope, sealing means at the upper end of said cylinder with respect to said piston rod, the piston rod and piston being provided with a central bore which extends longitudinally from towards the bottom end upwardly to the upper end where it is openable to the atmosphere, a passage interconnecting the bottom of the cylinder and the bottom of said bore, a passage containing a check valve for oil flow between said piston cylinder below said plunger piston and said piston cylinder above said plunger piston, the wall of said piston cylinder having an annular recess towards the upper end and said piston rod having a radially extending passage interconnecting said recess with the longitudinal bore in said piston rod.

15. A pile hammer rig comprising, a crane, a hoisting drum carried by said crane, driving means and braking means for said drum, a drop-weight, a hoisting rope leading from said drum for lifting said drop-weight, a device for connecting said hoisting rope to said drop-weight, including a piston cylinder formed at the upper end of said drop-weight, a piston rod carrying a plunger piston at the lower end thereof slidably mounted in said piston cylinder, the upper end of said piston rod being connectable to said rope, sealing means at the upper end of said cylinder with respect to said piston rod, the piston rod and plunger piston being provided with a central bore which extends longitudinally from towards the bottom end upwardly to the upper end where it is openable to the atmosphere, the bottom end of the bore being closed by a protruding plug portion, a recess in the bottom of the piston cylinder for receiving said plug portion, a passage interconnecting the bottom of the cylinder and the bottom of said bore, a thrust washer mounted on the top of said plunger piston, a guide bushing disposed towards the top end of said piston cylinder and having an internal bore for receiving said piston rod in sliding relationship, a plurality of disc springs interposed between said thrust washer and the bottom face of said guide bushing, a passage containing a check valve for oil flow from said piston cylinder below said plunger piston and to said piston cylinder above said plunger piston below said thrust washer, said guide bushing having an annular recess and said piston rod having a radially extending passage interconnecting said recess with the longitudinal bore in said piston rod.

* * * * *

UNITED STATES PATENT OFFICE
CERTIFICATE OF CORRECTION

Patent No. 4,002,211 Dated January 11, 1977

Inventor(s) Henry A. Nelson Holland

It is certified that error appears in the above-identified patent and that said Letters Patent are hereby corrected as shown below:

Column 1, line 34, "durm" to read -- drum --;

Column 10, line 34, "resrvoir" to read -- reservoir;

Column 16, line 1, "heat" to read -- head --.

Signed and Sealed this

Nineteenth Day of April 1977

[SEAL]

*Attest:*

RUTH C. MASON
*Attesting Officer*

C. MARSHALL DANN
*Commissioner of Patents and Trademarks*